United States Patent [19]

Davis et al.

[11] 4,349,571

[45] Sep. 14, 1982

[54] BULK CONE CONTAINER

[75] Inventors: Paul Davis, Swampscott, Mass.; David Weinstein, Baltimore, Md.; David Schneider, Lexington, Mass.

[73] Assignee: Sweetheart Plastics, Inc., Wilmington, Mass.

[21] Appl. No.: 967,506

[22] Filed: Dec. 7, 1978

[51] Int. Cl.[3] ..... B65D 81/16; B65D 85/36; B65B 23/00

[52] U.S. Cl. ..... 426/124; 206/499; 206/588; 206/592; 206/602; 217/26.5; 217/27; 229/2.5 R; 426/128; 426/115

[58] Field of Search ..... 206/83, 84, 443, 602, 206/523, 524, 588, 589, 590, 591, 592, 521, 499; 426/128, 108, 115, 119, 124, 396; 229/2.5 R; 217/21, 26.5, 27

[56] References Cited

U.S. PATENT DOCUMENTS

| | | | |
|---|---|---|---|
| 216,413 | 6/1879 | Huston | 217/33 |
| 240,141 | 4/1881 | Jaeger | 217/32 |
| 1,035,258 | 8/1912 | Stegman | 206/602 |
| 1,121,232 | 12/1914 | Davis | 206/443 |
| 1,121,735 | 12/1914 | Lawrence | 217/26.5 |
| 1,143,146 | 6/1915 | Shelton | 217/26.5 |
| 1,199,310 | 9/1916 | Shapiro | 217/26.5 |
| 1,202,986 | 10/1916 | Fogg | 217/31 |
| 1,353,629 | 9/1920 | Cibulka | 206/499 X |
| 1,977,160 | 10/1934 | White | 217/21 |
| 2,185,328 | 1/1940 | Buttermann | 206/499 |
| 2,750,028 | 6/1956 | Bode et al. | 229/2.5 |
| 2,838,173 | 6/1958 | Emery | 229/2.5 |
| 3,118,535 | 1/1964 | Bauman | 206/499 |
| 3,146,112 | 8/1964 | Weinstein | 426/124 |
| 3,240,331 | 3/1966 | Weinstein | 206/499 |
| 3,343,671 | 9/1967 | Weinstein | 206/499 |
| 3,400,873 | 9/1968 | Bessett | 206/499 |
| 3,406,856 | 10/1968 | Griffith et al. | 426/128 X |
| 3,540,582 | 11/1970 | Wood | 206/602 |
| 3,619,216 | 11/1971 | Weinstein | 426/124 |
| 3,647,105 | 3/1972 | Keeslar | 229/2.5 |
| 3,677,438 | 7/1972 | Esposito | 206/499 X |
| 3,710,931 | 1/1973 | Hollinger | 206/497 |
| 3,745,025 | 7/1973 | Hollinger | 426/124 |
| 3,835,994 | 9/1974 | Davis | 229/2.5 |
| 3,858,717 | 1/1975 | Peters | 426/108 |
| 3,937,322 | 2/1976 | Cohen | 206/499 X |
| 4,070,489 | 1/1978 | Pahnke | 426/124 |
| 4,072,232 | 2/1978 | Marsman et al. | 206/602 |
| 4,139,643 | 2/1979 | Hix et al. | 426/124 |

*Primary Examiner*—Steven L. Weinstein

*Attorney, Agent, or Firm*—Birch, Stewart, Kolasch & Birch

[57] ABSTRACT

A bulk package for stacked and nested ice cream cones is provided for transporting and dispensing the cones in which a plurality of folded foam sandwich structures each defining a row of cells holding one cone stack to a cell are inserted into an outer container to form a matrix of cells therein. In one embodiment, the sandwich structures and the outer container are sized such that a forced fit is developed between them to cause the cells to close down on and immobilize the stacked cones. The outer container is split open on two opposed sides at the point of use of the cones to relieve the forced fit and permit vending of the cones from the cells by gripping individual cone apices. The outer container is provided with an easy to split sidewall structure, if desired. In another embodiment the force fit is secured by comb-shaped clamps which close down the cells. Spacers are provided in both embodiments to hold the plastic sandwich structures in place when a lid is placed on the outer container.

21 Claims, 17 Drawing Figures

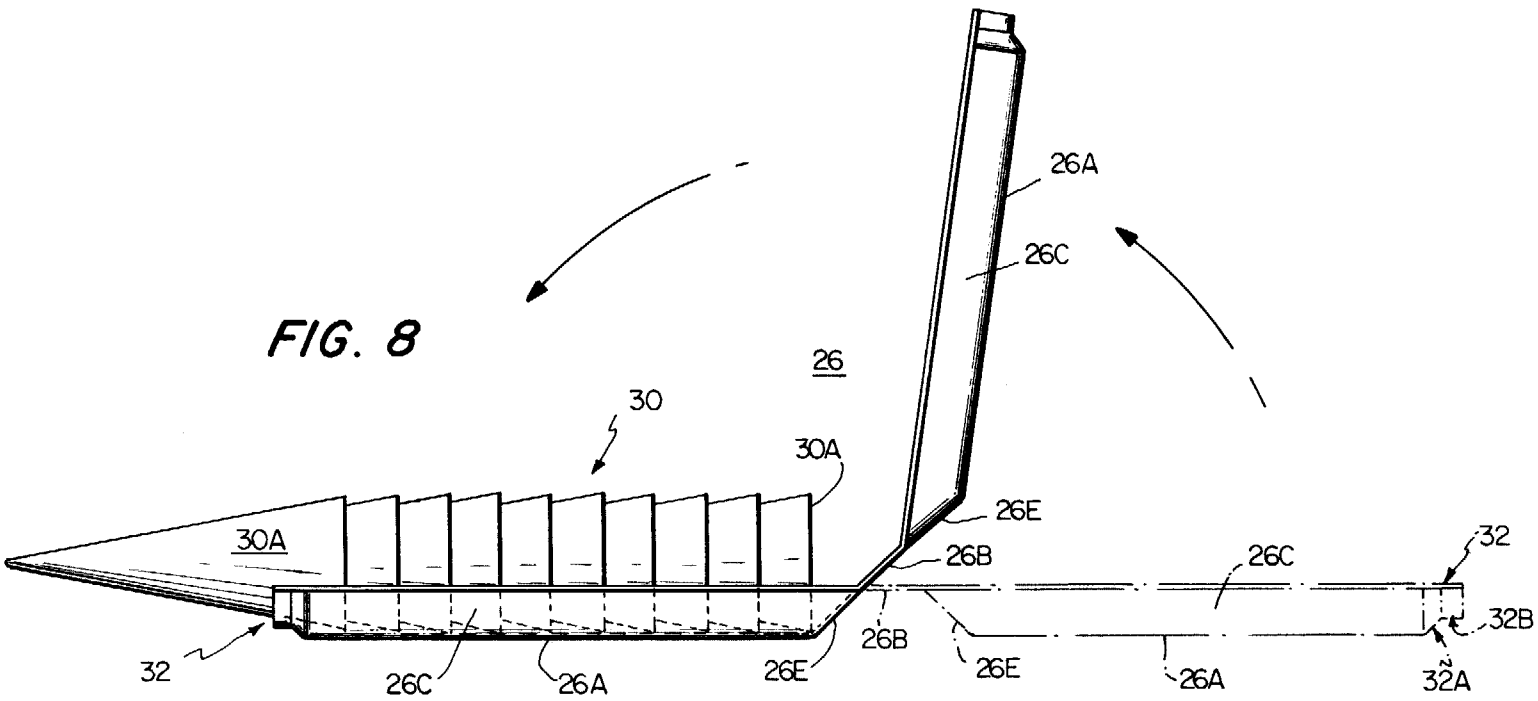
FIG. 8
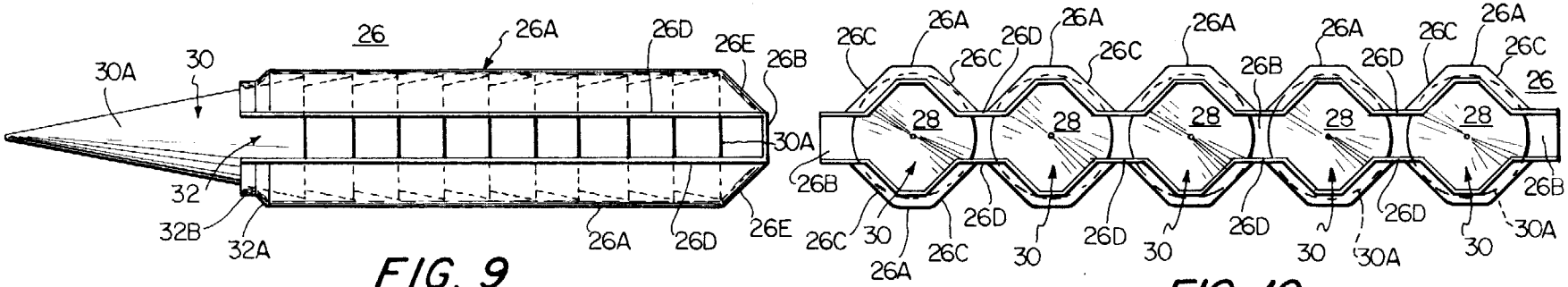
FIG. 9
FIG. 10

BULK CONE CONTAINER

FIELD OF THE INVENTION

The present invention relates to protective bulk packaging for stacked nested articles and, more particularly, to a bulk container for baked ice cream cones and the like which is so constructed as to permit dispensing of the cones from the package one at a time after the package has reached its destination.

BACKGROUND OF THE INVENTION

Many prior packages have been developed for holding a multiplicity of stacked ice cream cones. These packages have been fraught with undesirable characteristics, not the least of which is the propensity to cause breakage of the fragile products contained therein, namely, ice cream cones. The problems of the prior art are compounded when strength and safety are attempted to be combined with convenient dispensing of the product directly from the package at a reasonable cost. In some instances where sufficient strength and protective ability are provided in the package the dispensing of a plurality of cones on an individual basis from the package becomes quite cumbersome or impractical. Further, other packages from which the cones are readily dispensable are expensive to make, of undue bulk or are substantially devoid of protective ability.

It is, therefore, an object of the present invention to provide a new and novel ice cream cone package for containing a plurality of ice cream cones arranged in a plurality of coaxially nested stacks of ice cream cones, each stack being in an individual stack containing cell within the package, whereby, strength, rigidity and shock resistance are enhanced and wherein the multicell structure of the present invention is less complex and less expensive than prior art packages of the same type.

It is another object of the present invention to provide a new and novel ice cream cone package for containing a plurality of ice cream cones arranged in a plurality of coaxially nested stacks of ice cream cones, each stack being in an individual stack containing cell within the package, wherein a plurality of identically formed foam plastic sandwiches are provided to each define a single row of individual cone-containing cells and cooperate with adjacent sandwiches to form a cell matrix within the package.

Still another object of the present invention to provide a new and novel ice cream cone package for containing a plurality of ice cream cones arranged in a plurality of coaxially nested stacks of ice cream cones, each stack being in an individual stack identically formed foam plastic sandwiches are provided to each define a single row of individual cone-containing cells and cooperate with adjacent sandwiches to form a cell matrix within the package; and wherein the said package contains means for relieving the compressive forces within the package at the point of use of the cones contained therein to readily permit dispensing of the cones from the package.

These and other objects of the present invention will become more fully apparent with reference to the following specification and drawings which relate to preferred embodiments of the present invention.

SUMMARY OF THE INVENTION

The present invention comprises a bulk package for shipping and dispensing a plurality of vertical coaxial stacks of nested ice cream cones or other fragile articles and includes an outer corrugated cardboard carton or the like which may be suitably lined with a large polyethylene bag for purposes of protecting the ingredients from contamination. The outer container is basically rectangular and in the illustrated embodiment to be further described hereinafter is square in cross-section and includes what appears to be a matrix of octagonal cells, each of these cells being vertically disposed within the outer container and defining a protective pocket in which an individual stack of nested conical ice cream cones or other fragile articles is contained.

These cells in the matrix of cells are defined in individual rows of cells by means of folding plastic foam sandwich structures having symmetrical opposing portions folded about two longitudinally extending fold lines on either side of a narrow rectangular base or spacer, the latter being so dimensioned as to be compatible with the widest portion of the stacked ice cream cones or fragile articles to be placed in each individual cell in cooperation with the fact that the opposing cell defining portions of the plastic foam sandwich each contain a plurality of multisided or trapezoidal sections which when placed in opposition one to the other define a basically octagonal cell.

These trapezoidal cell portions or pockets formed in the plastic foam sandwich structures (fabricated for example from foamed polystyrene) include a plurality of externally facing lands which are adopted to be juxtaposed with corresponding external lands on adjacent sandwich structures such that when a plurality of such sandwich structures are forced into the outer carton, a compressive force sufficient to retain all of the stacks of cones immobile within their individual cells but without applying sufficient force to crush the fragile nested cones or other articles, will be applied substantially uniformly throughout the entire matrix of cells within the outer package.

The outer package, in turn, may be provided with slits or tear-away means in the sidewall of at least two opposing sides thereof such that when the carton reaches the point of use with the contained nested ice cream cones or other fragile articles, either edible or non-edible, the frangible or tear-away portions of the opposing sidewalls of the cartons may be ruptured to permit the outer container to expand slightly about the ruptured portion and relieve the internal compressive forces placed on the individual stacks of cones therein. This permits the cones to be withdrawn from the stacks one at a time, since in placing the stacks of cones within the respective retaining cells, the apices of the cones are placed uppermost and extend outward beyond the upper end of the plastic foam sandwich structures defining the cells. Of course, the carton may have no side slits and the sidewalls can be severed at the point of use to effect the required expansion.

Also, in order that the plastic foam sandwich structures remain immobilized and fully protect the ice cream cones or other fragile articles stacked therein, a cardboard or paperboard spacer extending over the tops of the folded plastic sandwich structures from that position to the uppermost extremity of the outer container is provided as a spacer. This spacer cooperates with a lid placeable on the container once the cones have been loaded into the cells, to maintain all of the contents of the outer container immobile upon placing the lid thereon. If this spacer is configured as an inverted stand, starburst cushioning sheets may be utilized over the tips of the cones. Such a spacer and starburst sheet structure is illustrated in U.S. Pat. No. 3,745,025 for Combined Shipping, Display, and Dispensing Package For A Plurality Of Nested Fragile Articles, issued July 10, 1973, to Paul Hollinger.

In an alternate embodiment of the present invention, a plurality of cardboard comb devices or the like are provided to interact with the indentations between the respective external lands on the trapezoidal pockets and on the ends of the various plastic sandwich structures defining the matrix of cone-retaining cells, thereby causing cone-retaining pressure to be applied on the cells by inserting the combs into the loaded package. This permits the package to remain intact and removal of the combs at the point of usage of the cones will relieve the pressure and provide the dimensional change required at the point of use to withdraw the cones one at a time from the individual cells.

BRIEF DESCRIPTION OF THE DRAWING

FIG. 1 is a top-plan view of a bulk package of the present invention with the top removed and with corner walls of the outer container thereof illustrated schematically in partial cross-section to illustrate a matrix of cells holding a plurality of stacked ice cream cones or the like;

FIG. 8 is a side elevation illustrating the operation of one of the plastic foam sandwich structures of the present invention including a fully opened view in phantom and a partially closed view in solid lines;

FIG. 9 is a side elevation of a closed plastic foam sandwich structure of the present invention;

FIG. 10 is a top-end view of a fully closed and loaded plastic foam sandwich structure of the present invention;

DETAILED DESCRIPTION OF THE DRAWINGS

Referring jointly to FIGS. 1, 7, 8, 9, 10, 11 and 12, the bulk package 20 is illustrated as including an outer container 22 of doublefaced corrugated board or the like which preferably includes a liner 24 comprised of a polyethylene bag or the like into which have been inserted a plurality of foam plastic sandwich structures 26.

Figure 1:
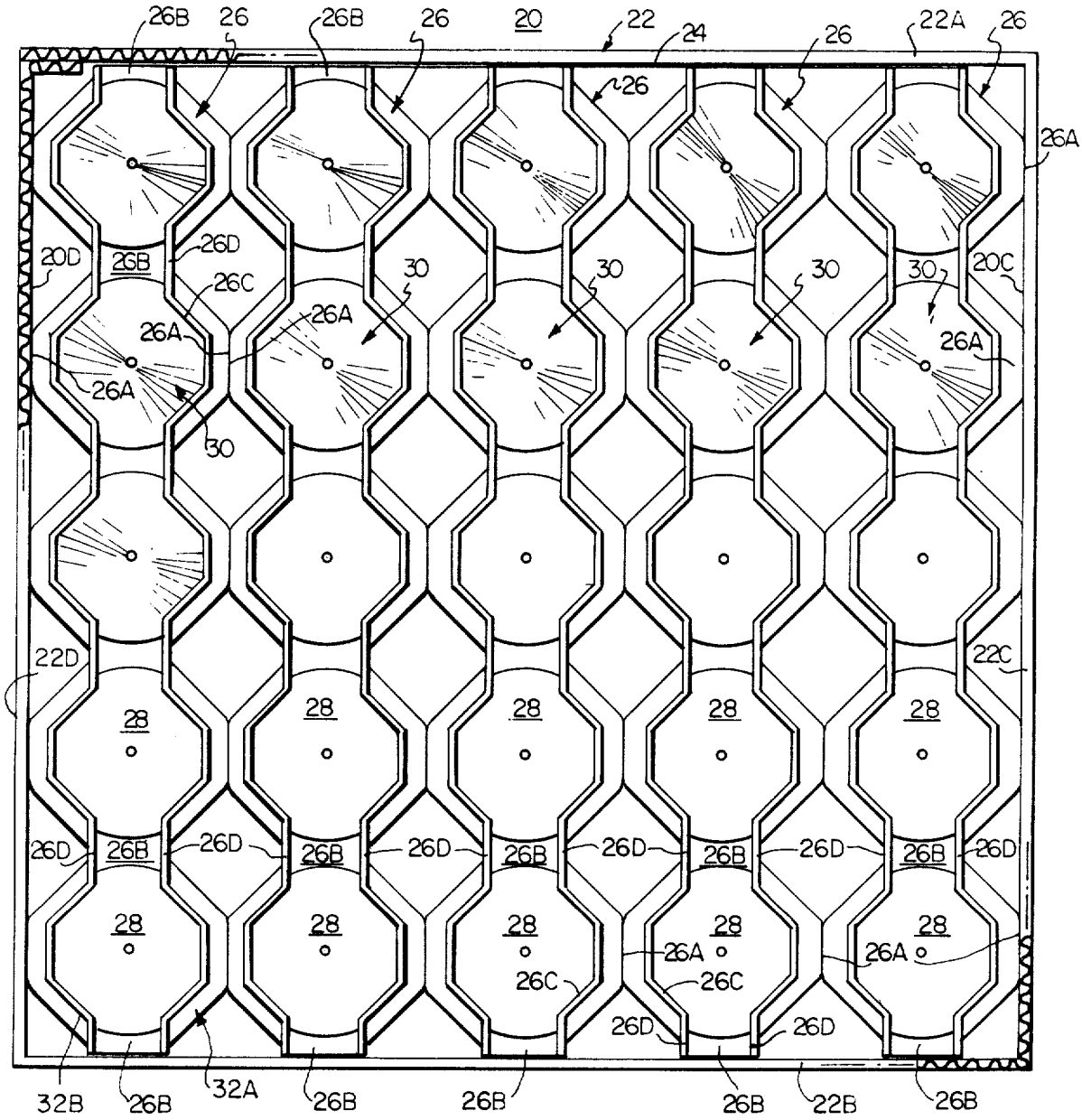

The plastic foam sandwich structures 26 include vertically disposed flat lands 26A on opposite sides thereof extending vertically upward from a bottom flat portion 26B which extends for the full extremity of the sandwich 26, namely, from one sidewall 22A of the package 20 to the other sidewall 22B thereof as illustrated in FIG. 1.

These vertical lands 26A on the outermost extremities of the plurality of plastic sandwich structures 26 are juxtaposed with the opposite pair of sidewall numbers 22C and 22D of the outer container 22 and within the interior of the outer container 22 are mutually juxtaposed one with another for a purpose to be hereinafter more fully described. For the present time suffice it to say that these vertical lands or flats 26A of the foam plastic sandwich structure 26 are forcibly juxtaposed such that a compressive force is generated therebetween and between the outermost of these lands 26A and the opposite pair of sidewalls 22C and 22D of the outer container 22.

Each of the vertical lands 26A is symmetrically disposed between angular sidewall portions 26C which extend at least coextensively with the vertical lands 26A at an angle of 45° with respect thereto. All of the surfaces comprising the lands 26A and the sidewall portions 26C are flat planar surfaces.

The innermost extremity of the canted sidewall portions 26C intersect at an angle of 45° with a rectangular flat inboard and parallel to the substantially rectangular vertical lands 26A to thereby define a bridging structure between each of a plurality of cells 28 forming a matrix pattern of such cells as illustrated in the lower portion of FIG. 1 of the drawings.

As illustrated in FIGS. 1 and 10, in particular, this combination of the canted side surfaces 26C, rectangular flats 26D and vertically extending lands 26A parallel to the said rectangular flats 26D in symmetrical halves of the sandwich structure 26 provide a plurality of cells 28 which are basically octagonal in nature, with the octagons having a pair of open opposed sides and three sides opposing another symmetrical set of three sides. Thus, there is formed a substantially octagonal elongated symmetrical cell which in the closed condition of the sandwich 26 as illustrated in FIG. 9 provides a distance between opposed lands 26A and flats 26D, when the opposed flats 26D are substantially parallel one with the other to receive the largest dimension of each of the cones 30A in a stack of cones 30 held within each of the said elongated octagonal cells 28.

The closed end of the plastic foam sandwich structure 26 is defined by the bottom flat 26B together with sloping end walls 26E extending downward and outward into intersection with the bottom flat 26B from the vertical lands 26A at an angle of 45° to the vertical lands 26A as well as to the bottom flat 26B when the sandwich structure 26 is in its fully opened position. These relationships are fully illustrated in regard to FIGS. 8 and 9.

The lines of intersection of the end surfaces 26E with the vertical lands 26A define a boss for precluding the lowermost of the cones 30A in the stack of cones 30 from descending past those lines of intersection when the plastic foam sandwich 26 is in its closed position and also to provide indexing bosses to which a stack of cones 30 may be indexed when the plastic foam sandwich structure 26 is in its open condition ready to receive a full load of cone stacks 30.

Figure 11:
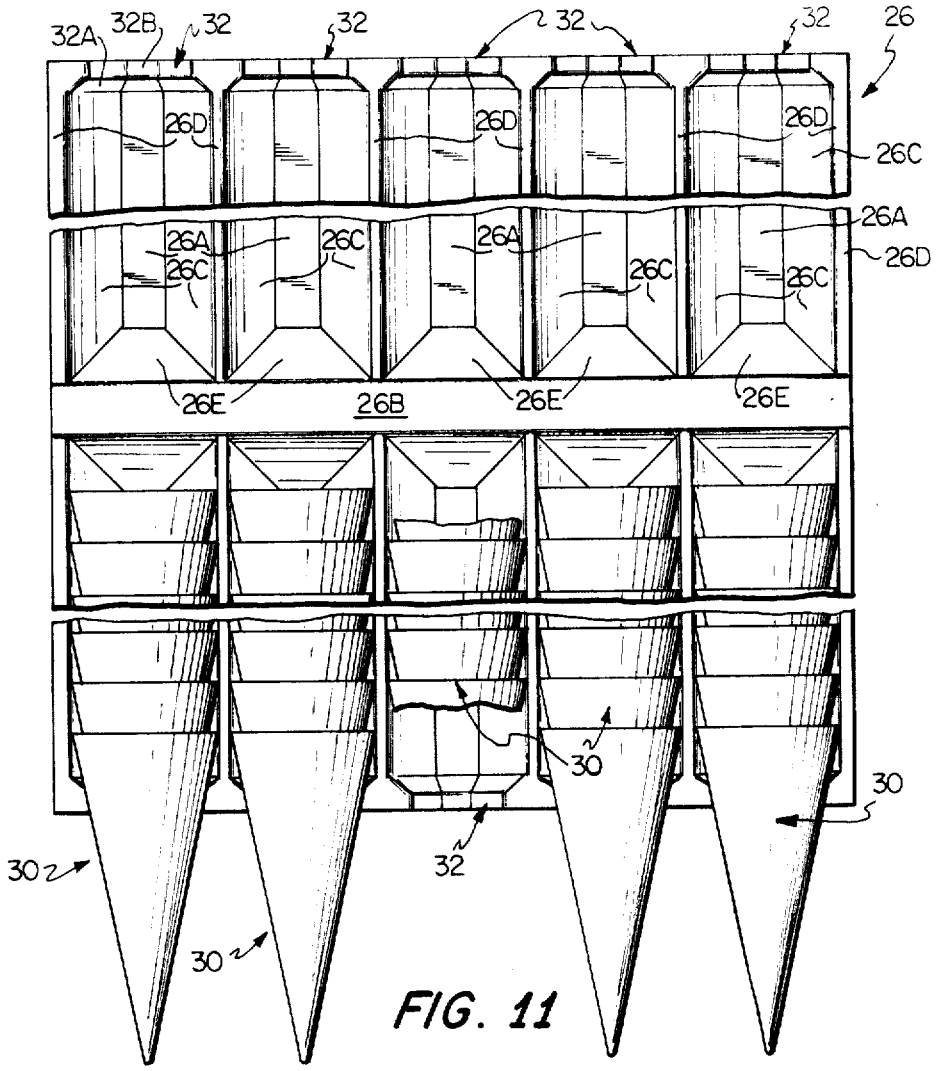
FIG. 11 is a partial top-plan view of a fully opened and reclining plastic sandwich structure with stacked and nested ice cream cones placed therein prior to closure of the said sandwich structure.
Figure 12:
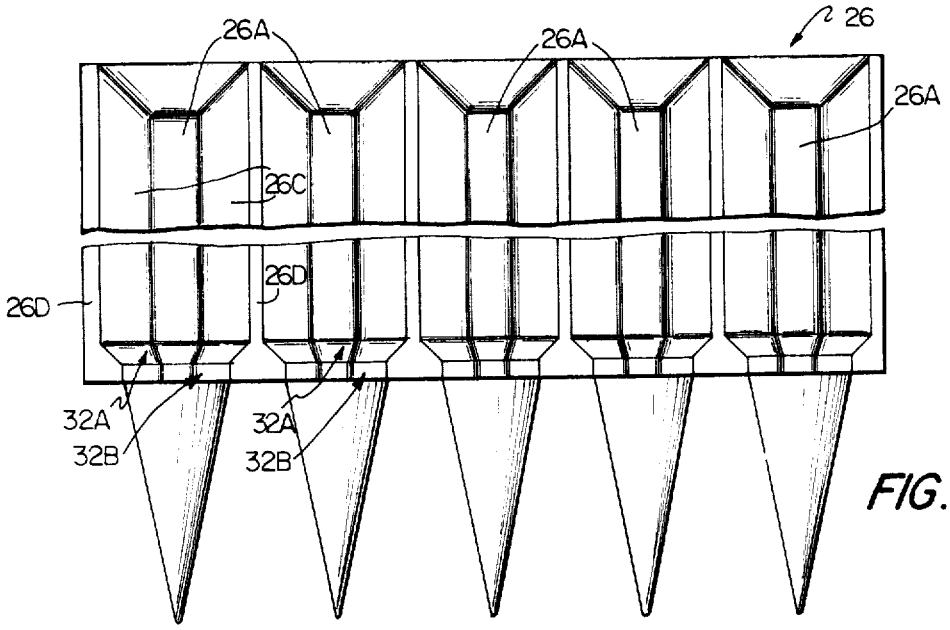
FIG. 12 is a top-plan view of the loaded plastic foam sandwich structure of FIG. 11 in the closed condition.

The uppermost portion of each of the cells 28 (although illustrated in FIGS. 11 and 12 as the lowermost portions thereof) are defined by mutually intersecting 45° surfaces 32A extending from each of the vertical lands 26A, canted wall surfaces 26C and their respective lines of intersection including the lines of intersection with the rectangular flats 26D provide a symmetrical necking down of the internal portions of the respective cells 28 to provide a neck down mouth portion 32 in each half of the plastic foam sandwich 26 which is foldable about the bottom flat 26B as best illustrated in FIG. 11. The external surface 32A generally defining the narrowed down neck portions 32 are best illustrated in FIGS. 1, 7 through 10 and 12. Each of the necked down surfaces 32A are further extended by means of surfaces 32B mutually parallel with the surfaces defined by the lands 26A, canted wall portions 26C and extensions of the rectangular flats 26D. This completes the necked down mouth portion 32 at the open end of the plastic foam sandwich structure 26.

A compressive force is generated when the sandwich structure 26 is closed, which is sufficient, because of the resilient nature of the plastic foam cells and the respective lands 26A and wall portions 26C in conjunction with the open but narrow neck portion 32, to maintain the various cones 30A within the stacks 30 in a fixed, gripped and cushioned position within the overall container and package 20 when the lands of a plurality of such sandwich structures are juxtaposed and compressed therein..

Figure 7:
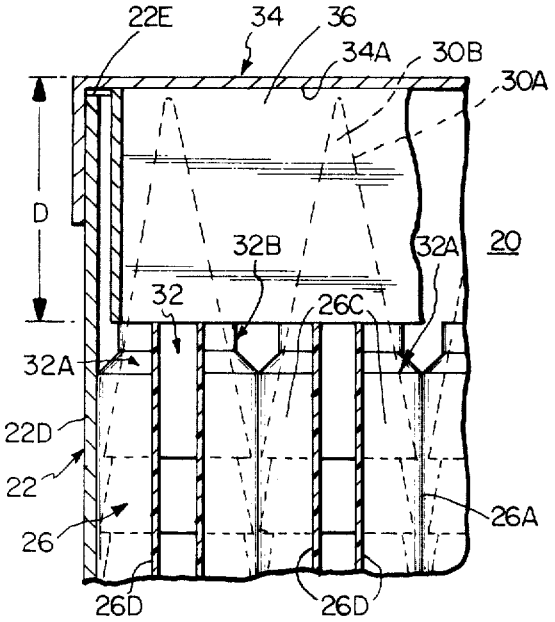
FIG. 7 is a cross-section taken along line 7—7 of FIG. 4.

Referring now to FIG. 7 in conjunction with FIGS. 4, 5 and 6, it is clearly illustrated that the uppermost extended surfaces 32B in the narrowed neck portion 32 of the respective sandwich structures 26 terminate a substantial distance D below the upper edge 22E of the outer carton 22, which also defines the distance D between the upper edge of the necked down portion 32 and the underside 34A of a container lid 34 which is placed upon package 20 as the final element thereof after it is fully loaded with cones 30A.

Figure 4:
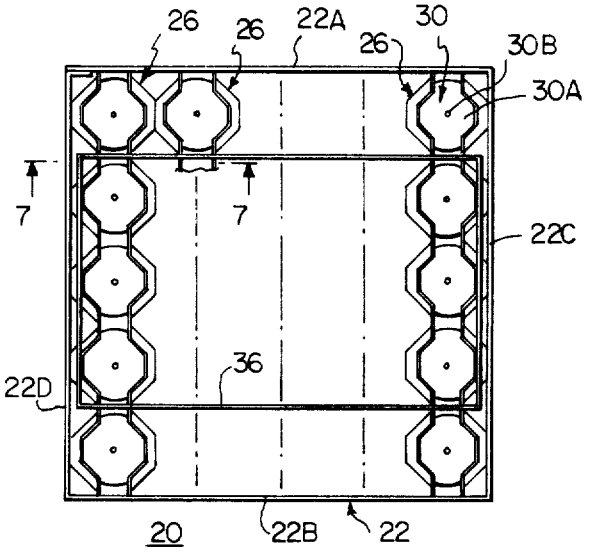
FIG. 4 is a schematic top-plan view of a cell matrix and outer container of the present invention including one preferred embodiment of a boss means for retaining the plastic foam cell defining sandwiches of the present invention in position.
Figure 5:
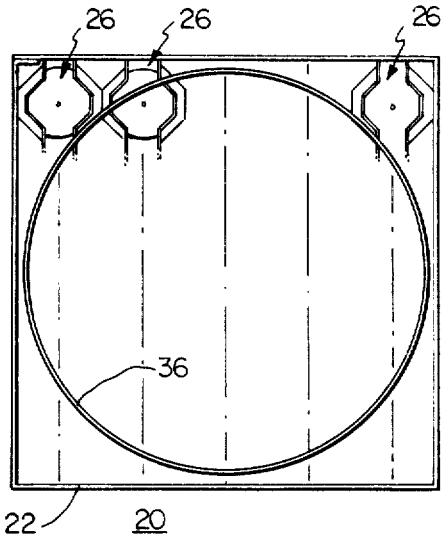
FIG. 5 is another embodiment of a plastic sandwich and boss structure of the present invention.
Figure 6:
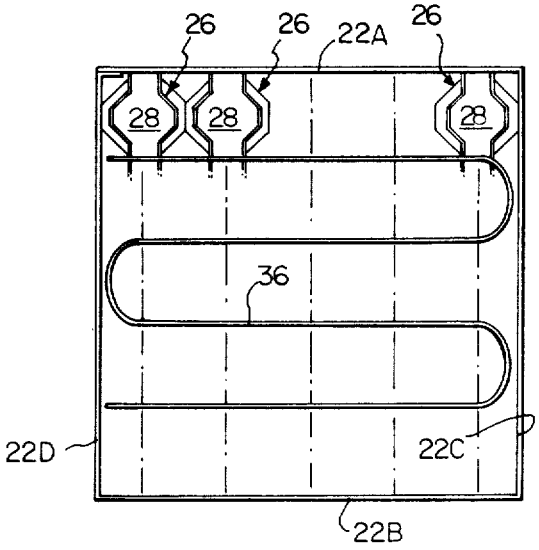
FIG. 6 is yet another embodiment of the plastic sandwich and boss structure of the present invention.

Positioned on edge and having its width equal to the vertical dimension D between the uppermost ends of the extended surfaces 32B and the said underside 34A of the container top 34 is a spacer or boss 36 (which can be either in a rectangular configuration as shown in FIG. 4, a cylindrical configuration as shown in FIG. 5, or a serpentine configuration as illustrated in FIG. 6 or any suitable variation thereof) configured to extend between the respective cells 28 so as not to engage the walls of the individual cones 30A and stacks 30. The space 36 precludes movement of the matrix of cells and the individual sandwiches 26 constituting that matrix and thereby precludes movement of the cone stacks 30 and damage to the cones 30A therein during shipping.

Figure 2A:
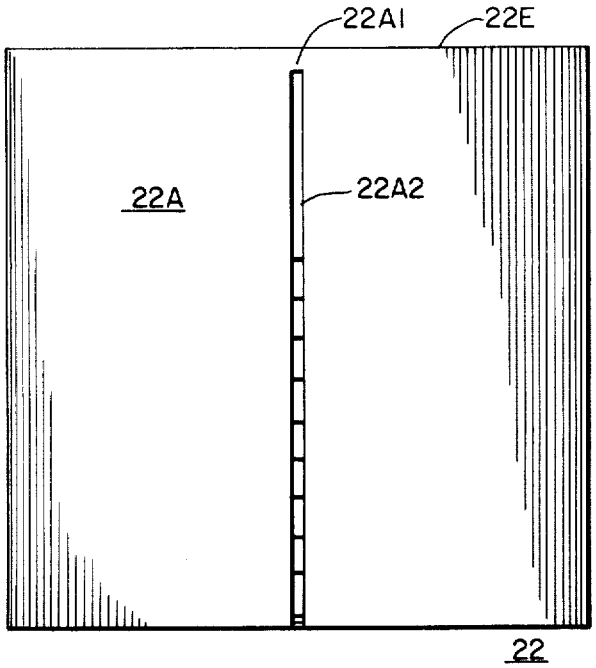
FIG. 2A is a side elevation of one embodiment of the outer container of FIG. 1 illustrating a rupturable side construction thereof prior to rupture.
Figure 2B:
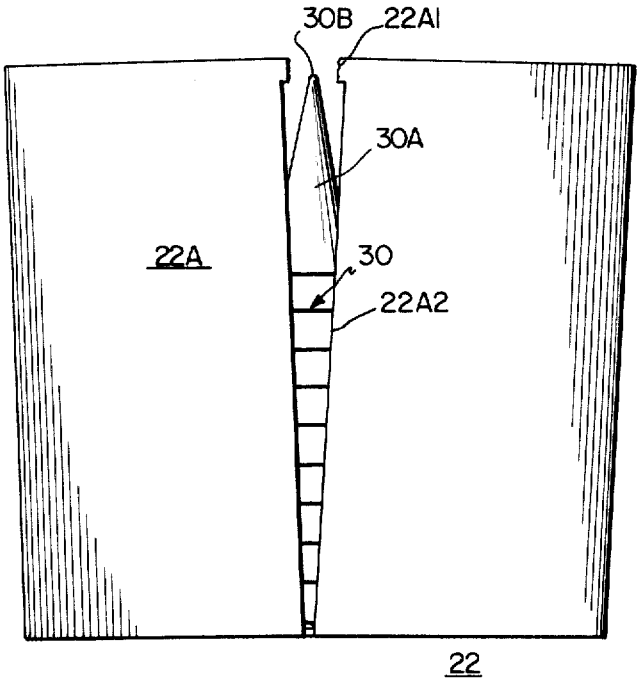
FIG. 2B is a side elevation of the embodiment of FIG. 2A in which the rupturable portion has been ruptured.

At a point of destination, where the cones 30A are to be utilized, it is necessary to dispense them one cone at a time from the overall package 20. In this regard, reference is now made to FIGS. 2A and 2B in which the sidewalls 22A, representative of the opposing sidewalls 22B as well, are shown as being slit from top to bottom and having a web or bridge 22A1 closing off a slot 22A2 which extends substantially from the bottom of the sidewall 22A (22B) to a point approximately the top edge 22E of the outer carton or container 22.

Upon reaching destination, the frangible webs 22A1 (which may consist of a plurality of spaced webs or bridging elements across the slot 22A2) in both sidewalls 22A and 22B of the container 22 are ruptured to permit the slots 22A2 to enlarge and release the compressive forces between the respective sandwich structures 26 within the matrix of cells 28. This permits the necked down portions 32 to separate to a sufficient extent to remove one cone at a time from each of the stacks 30 by gripping the apex 30B of the uppermost cone 30A in a stack 30 from the position best illustrated in FIGS. 2B and 7, assuming that the container lid 34 has been removed and the polyethylene bag 24 has been opened to permit access to the apices of the cones 30A.

Now, by simply gripping the uppermost cone 30A adjacent the apex 30B thereof and pulling vertically upward, the relief of compressive forces on the sandwich 26 permits the mouth or narrowed neck portion 32 thereof to expand and cam outwardly on the surface of the gripped cone 30A to release that cone and then gently return to an enveloping position on the next cone 30A therebeneath.

Figure 3A:
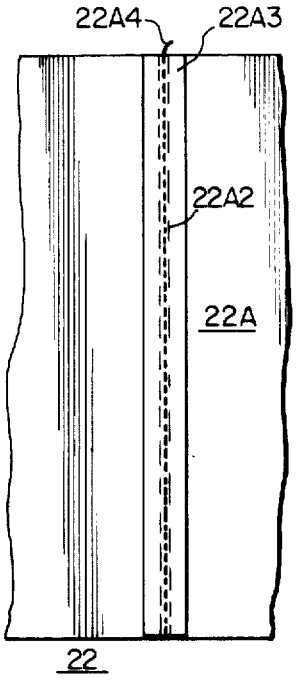
FIG. 3A is a tear-tape embodiment of the rupturable sidewall of the outer container shown in partial side elevation in an unruptured state.
Figure 3B:
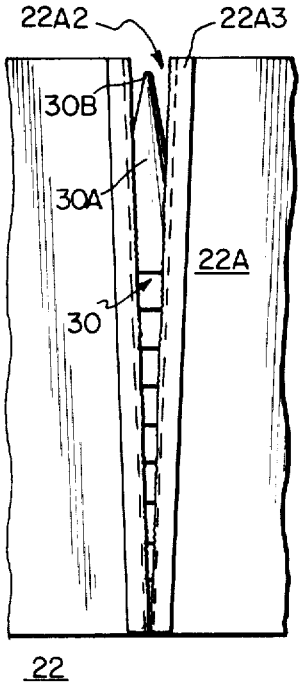
FIG. 3B illustrates the ruptured state of the rupturable portion of FIG. 3A.

An alternate embodiment of the means by which the sidewall 22A as well as the opposing sidewall 22B may be caused to spread and relieve the internal stresses and compressive forces on the plastic sandwich structure 26 is illustrated in FIGS. 3A and 3B in which a sealing tape 22A3 is positioned over a fully defined slit 22A2 extending vertically of the entire sidewall 22A and a tear-strip 22A4 is provided within the sealing 22A3 to cause that tape to be ruptured from top to bottom and relieve the compressive forces on the cone stacks 30. Thus, that the uppermost cones 30A in the stacks can then be gripped by their apices 30B and dispensed as previously described.

An alternate embodiment of the present invention is illustrated with reference to FIGS. 13, 14, and 15 as including a plurality of spreaders 38 which are configured with a solid upper portion 38A and dependent comb-shaped teeth 38B which taper toward their lower extremities 38C. These tapered extremities 38C provide a wedging action when the said lower extremities 38C are slipped into the substantially diamond-shaped elongated cell cavities 40 defined between opposing rectangular flats 26D and adjacent canted side surfaces 26C of adjacent plastic foam sandwich structures 26 within the carton 22. The outermost tines or comb teeth 38B on the comb structure 38 and the tapered lower extremities 38C thereon are forcibly engaged in triangular shaped cavities or cells 40A as best illustrated in FIGS. 14 and 15.

The tapered shapes of the dependent comb teeth 38B define progressively narrowing slots 38D therebetween such that when the comb structures 38 are forced down into the diamond-shaped cavities 40 and the triangular shaped cavities 40A, the rectangular flats 26D are engaged externally on each of the said plastic foam sandwich structures 26 and pressed together by virtue of the taper in the slots 38D to close down the cells 28 within the respective plastic foam sandwich structures 26 onto the cone stacks 30 within those cells 28 to thereby provide the compressive force to grip and maintain the respective cone stacks 30 immobile within the overall package structure.

Then, at the point of destination in order to provide for dispensing of one cone at a time from each stack of cones, the comb structures 38 are removed from the package and the compressive forces in each of the sandwich structures 26 are thereby relieved. This permits the cones 30A to be dispensed from each of the stacks 30 one at a time in the manner previously described for the embodiment of FIGS. 1 through 12.

Figure 13:
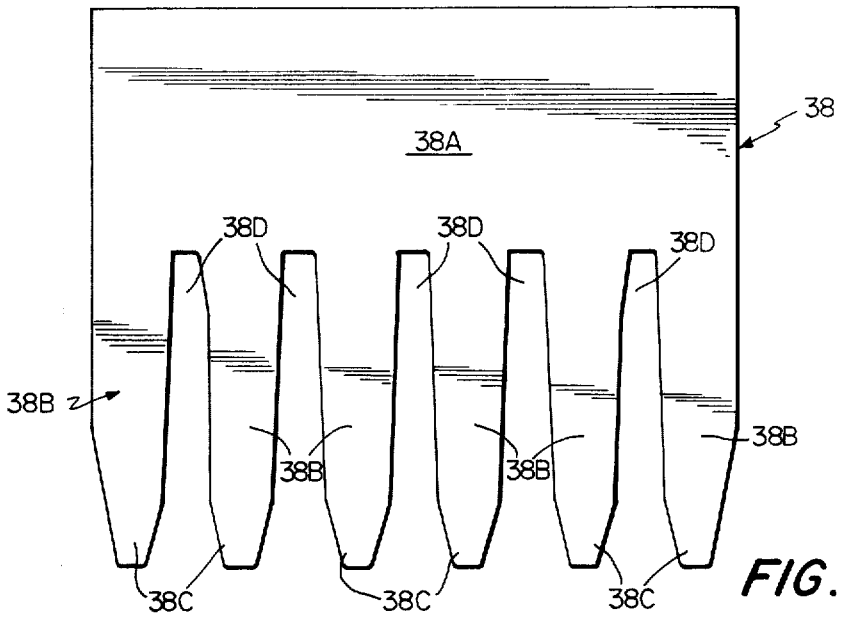
FIG. 13 is a side elevation of a cell closing and retaining comb structure of the present invention.
Figure 14:
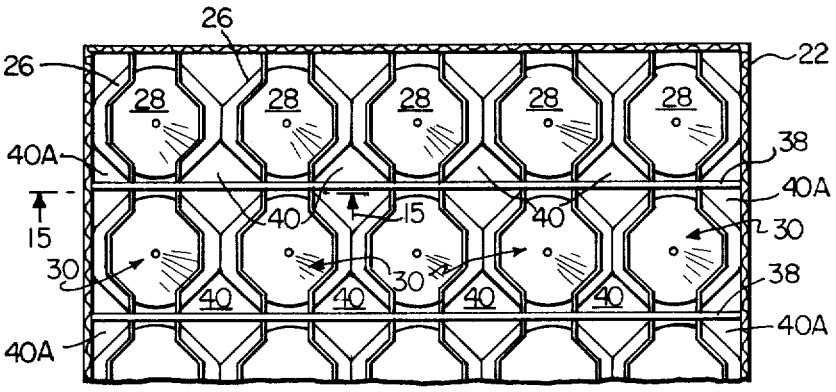
FIG. 14 is a top-plan view schematic of a container of the present invention with the comb structures of FIG. 13 inserted therein.
Figure 15:
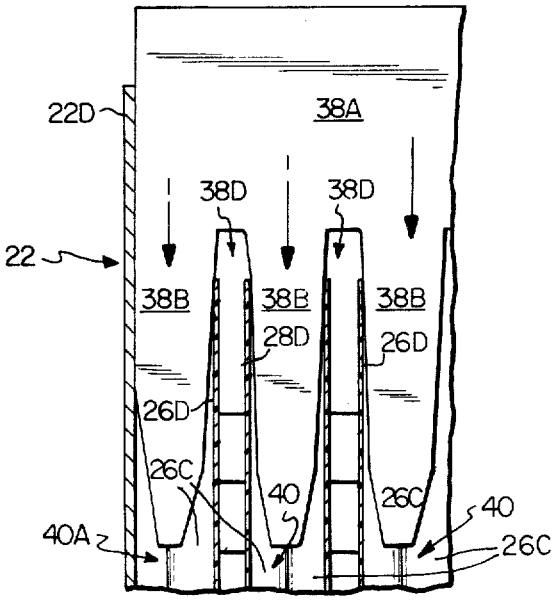
FIG. 15 is a partial cross-section taken along lines 15—15 of FIG. 14, illustrating the insertion of the said comb structure of FIG. 13 into the container of the present invention.

It should be noted, that in the embodiments of FIGS. 13 through 15, the relative dimensions of the plastic foam sandwich structures 26 and the outer carton 22 are at a much looser tolerance than in the foregoing embodiment such that when the comb structures 38 are removed, the requisite degree of play is established between the sandwich structures 26 to permit dispensing of the cones 30A therefrom.

It should be understood that the BULK CONE CONTAINER of the present invention may be modified as would occur to one of ordinary skill in the art without departing from the spirit and scope of the present invention.

It is claimed:

1. Bulk container means for shipping and dispensing a plurality of stacked and nested substantially conical fragile articles, including a matrix of protective cells each holding a stack of said nested substantially conical fragile articles, comprising:

a plurality of foam sandwich means defining said matrix, each comprising a row of a like number of multisided resilient cells, each of said cells having opposed open sides and having at least two substantially opposed and coextensive lands engageable externally thereof to close down said open sides and having sidewalls configured to engage only the largest transverse dimension of said substantially conical articles for resiliently engaging therewith to preclude axial movement of said articles in said cells; and an external container shell dimensioned to receive said plastic foam sandwich means in compressive juxtaposition with the outermost said lands on said sandwich means;

said lands on said plurality of plastic foam sandwich means being in registry and compressive juxtaposition throughout said matrix to substantially uniformly apply a closing force to all of said resilient cells.

2. The invention of claim 1, wherein said external container shell further includes release means for releasing said closing force on said resilient cells.

3. The invention of claim 1, wherein:

said external container shell has a first pair of opposed sidewalls in juxtaposition with said outermost lands on said sandwich means; and said external container shell has a second pair of opposed sidewalls selectively rupturable to relieve said closing force on said resilient cells.

4. The invention of claim 1, wherein said plastic foam sandwich means further comprises:

a substantially rectangular bottom member extending coterminately with said row of cells; and first and second symmetrical opposed side members foldably joined with said bottom member along the longitudinal edges thereof and foldable one toward the other to define said sandwich structure and said row of cells;

each side member defining a portion of each of the cells in said sandwich means with at least three side surfaces in a substantially symmetrical trapezoidal configuration, open at one side and each having a closed side surface comprising one of said coextensive lands.

5. The invention of claim 4, wherein each of said three side surfaces further include convergent extension surfaces defining a reduced neck portion opposite said bottom member in each of said cells defined by said sandwich means.

6. The invention of claim 4, wherein said coextensive land includes a convergent surface portion adjacent said rectangular bottom member extending from a line of demarcation with said land to a common line of intersection with said bottom member and the other of said side surfaces in each said cell portion;

said lines of demarcation and said convergent surface portions in said opposed cell portions cooperating to provide a detent for precluding a fragile article contained in said cell from engaging said rectangular bottom member.

7. The invention in any one of claims 4, 5 and 6, wherein said external container shell further includes release means for releasing said closing force on said resilient cells.

8. The invention in any one of claims 4, 5 and 6, wherein:

said external container shell has a first pair of opposed sidewalls in juxtaposition with said outermost lands on said sandwich means; and said external container shell has a second pair of opposed sidewalls selectively rupturable to relieve said closing force on said resilient cells.

9. Bulk container means for shipping and dispensing a plurality of stacked and nested substantially conical fragile articles, including a matrix of protective cells each holding a stack of said nested substantially conical fragile articles, comprising:

a plurality of plastic foam sandwich means defining said matrix each comprising a row of a like number of multisided resilient cells each cell having opposed open sides and having at least two substantially opposed and coextensive lands engageable externally thereof to close down said open sides and having sidewalls configured to engage only the largest transverse dimension of said substantially conical articles for resiliently engaging therewith to preclude axial movement of said articles in said cells;

an external container shell dimensioned to receive said plastic foam sandwich means in compressive juxtaposition with the outermost said lands on said sandwich means;

said lands on said plurality of plastic foam sandwich means being in registry and compressive juxtaposition throughout said matrix to substantially uniformly apply a closing force to all of said resilient cells;

said external container shell including a bottom member supporting said sandwich means and a removable cover displaced from the uppermost ends of said sandwich means;

said cells being open ended to permit articles held therein to extend therefrom into proximity with said cover; and spacer means mutually engageable with said cover and said uppermost ends of said sandwich means precluding engagement between said articles of said cover by fixing said sandwich means between said cover and said bottom member.

10. The invention of claim 9, wherein said external container shell further includes release means for releasing said closing force on said resilient cells.

11. The invention of claim 9, wherein:

said external container shell has a first pair of opposed sidewalls in juxtaposition with said outermost lands on said sandwich means; and said external container shell has a second pair of opposed sidewalls selectively rupturable to relieve said closing force on said resilient cells.

12. The invention of claim 9, wherein said plastic foam sandwich means further comprises:

a substantially rectangular bottom member extending coterminately with said row of cells; and first and second symmetrical opposed side members foldably joined with said bottom member along the longitudinal edges thereof and foldable one toward the other to define said sandwich structure and said row of cells;

each side member defining a portion of each of the cells in said sandwich means with at least three side surfaces in a substantially symmetrical trapezoidal configuration, open at one side and each having a closed side surface comprising one of said coextensive lands.

13. The invention of claim 12, wherein each of said three side surfaces further include convergent extension surfaces defining a reduced neck portion opposite said bottom member in each of said cells defined by said sandwich means.

14. The invention of claim 12, wherein said coextensive land includes a convergent surface portion adjacent said rectangular bottom member extending from a line of demarcation with said land to a common line of intersection with said bottom member and the other of said side surfaces in each said cell portion;

said lines of demarcation and said convergent surface portions in said opposed cell portions cooperating to provide a detent for precluding a fragile article contained in said cell from engaging said rectangular bottom member.

15. The invention of any one of claims 12, 13 and 14, wherein said external container shell further includes release means for releasing said closing force on said resilient cells.

16. The invention in any one of claims 12, 13 and 14, wherein:

said external container shell has a first pair of opposed sidewalls in juxtaposition with said outermost lands on said sandwich means; and said external container shell has a second pair of opposed sidewalls selectively rupturable to relieve said closing force on said resilient cells.

17. A resilient, plastic foam sandwich structure defining a row of multi-sided cells for receiving in each cell a plurality of stacked and nested substantially conical fragile aticles and maintaining the latter in a cushioned and motionless condition, comprising:

a substantially symmetrical elongated unitary formed foam sheet including a transversely disposed elongated central panel and first and second end panels of substantially identical formation foldable one toward the other along respective and parallel side edges of said central panel to form a U-shaped sandwich;

a like plurality of elongated and multisided open cavities formed in each said end panel, corresponding ones of said open cavities in respective end panels being in opposed registry to form a row of multisided cells in said U-shaped sandwich, said cells being open at two opposed sides and at the ends thereof remote from said central panel;

each of said open cavities having at least one wall portion proximate thereto configured as an engageable surface means for imparting a closing force to said cells in said U-shaped sandwich and at least two wall portions extending longitudinally thereof, defining the outer boundaries thereof and configured to resiliently engage only the largest transverse dimensions of said substantially conical articles to preclude axial movement of said fragile articles in said cells;

a combshaped clamping means including an upper body portion and at least two dependent teeth defining a convergent slot therebetween with the inboard edges thereof; and said inboard edges slidably and telescopically engaging opposed ones of said engageable surface means to selectively impart and release said closing force to and from said cells.

18. The sandwich structure of claim 17 in combination with an external container having at least two opposing sidewalls in compressive juxtaposition with said engageable land means to impart said closing force to said cells.

19. The combination of claim 17 in further combination with an external container shell;

said container shell including a bottom member supporting said central panel and a top member spaced from the open upper ends of said end panels to permit articles held therein to extend therefrom into proximity with said cover; and said upper body portion of said clamping means comprising spacer means mutually engageable with said cover and said sandwich means at said upper ends of said panels precluding engagement between said articles and said cover by fixing said sandwich means between said cover and said bottom member.

20. The invention of any one of claims 17, 18 and 19, which further includes a stack of nested conical articles in each of said cells having enlarged open ends disposed toward and adjacent said central panel and apices disposed toward and extending from said open ends of said cells.

21. The invention of any one of claims 17, 18 and 19, which further includes a stack of nested conical articles in each of said cells having enlarged open ends disposed toward and adjacent said central panel and apices disposed toward and extending from said open ends of said cells;

said nested fragile articles comprising baked ice cream cones.

* * * * *